US007493058B2

(12) United States Patent
Takeuchi et al.

(10) Patent No.: US 7,493,058 B2
(45) Date of Patent: Feb. 17, 2009

(54) IMAGE FORMING APPARATUS AND TONER CONCENTRATION CONTROLLING METHOD

(75) Inventors: Nobutaka Takeuchi, Kanagawa (JP); Shin Hasegawa, Kanagawa (JP); Kohta Fujimori, Kanagawa (JP); Kayoko Tanaka, Tokyo (JP); Yushi Hirayama, Kanagawa (JP); Hitoshi Ishibashi, Kanagawa (JP); Osamu Ariizumi, Kanagawa (JP); Naoto Watanabe, Kanagawa (JP); Shinji Kato, Kanagawa (JP); Shinji Kobayashi, Kanagawa (JP); Kazumi Kobayashi, Tokyo (JP); Takashi Enami, Kanagawa (JP); Fukutoshi Uchida, Kanagawa (JP); Ryohta Morimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 316 days.

(21) Appl. No.: 11/498,059

(22) Filed: Aug. 3, 2006

(65) Prior Publication Data

US 2007/0036566 A1 Feb. 15, 2007

(30) Foreign Application Priority Data

Aug. 22, 2005 (JP) ..... 2005-240446

(51) Int. Cl.
*G03G 15/08* (2006.01)

(52) U.S. Cl. ..... 399/58; 399/59

(58) Field of Classification Search ..... 399/58, 399/59, 53, 85, 27, 30
See application file for complete search history.

(56) References Cited

U.S. PATENT DOCUMENTS 4,638,760 A * 1/1987 Nakamura et al.
4,653,896 A * 3/1987 Horie et al.
5,493,382 A 2/1996 Takagaki et al.
5,604,575 A 2/1997 Takagaki et al.
5,737,680 A 4/1998 Takagaki et al.

(Continued)

FOREIGN PATENT DOCUMENTS

JP 5-232814 9/1993

(Continued)

OTHER PUBLICATIONS

U.S. Appl. No. 11/952,553, filed Dec. 7, 2007, Tomita et al.

(Continued)

*Primary Examiner*—Susan S Lee
(74) *Attorney, Agent, or Firm*—Oblon, Spivak, McClelland, Maier & Neustadt, P.C.

(57) ABSTRACT

The image forming apparatus includes a developing device that holds a two-component developer to develop an image, a detecting unit that outputs a reference output value and a second output value when the two-component developer is stirred and carried at a stirring/carrying speed corresponding to a second image forming mode, a stirring/carrying member that stirs and carries the two-component developer, and a controlling unit that controls the toner concentration based on the reference output value when forming an image in a first image forming mode, and controls the toner concentration, when forming an image in the second image forming mode, a corrected output value obtained by correcting an output value in the second image forming mode with a difference value between the reference output value and the second output value.

12 Claims, 10 Drawing Sheets

U.S. PATENT DOCUMENTS

| | | | |
|---|---|---|---|
| 2003/0147661 | A1 | 8/2003 | Ogata |
| 2003/0228164 | A1 | 12/2003 | Katoh |
| 2007/0036566 | A1 | 2/2007 | Takeuchi et al. |

FOREIGN PATENT DOCUMENTS

| | | | |
|---|---|---|---|
| JP | 8-248765 | | 9/1996 |
| JP | 9-236983 | | 9/1997 |
| JP | 11-272061 | | 10/1999 |
| JP | 2000-89554 | | 3/2000 |
| JP | 2002-14588 | | 1/2002 |
| JP | 2002-40794 | | 2/2002 |
| JP | 2002-040794 | A | 2/2002 |
| JP | 2002-169369 | | 6/2002 |
| JP | 2002-207357 | | 7/2002 |
| JP | 3400588 | | 2/2003 |
| JP | 2003-280355 | | 10/2003 |
| JP | 2003-280355 | A | 10/2003 |
| JP | 2003-295601 | | 10/2003 |
| JP | 2004-20614 | | 1/2004 |
| JP | 2004-70067 | | 3/2004 |
| JP | 2004-117895 | | 4/2004 |

OTHER PUBLICATIONS

U.S. Appl. No. 12/112,525, filed Apr. 30, 2008, Koizumi et al.
U.S. Appl. No. 11/748,090, filed May 14, 2007, Takeuchi et al.
U.S. Appl. No. 11/761,731, filed Jun. 12, 2007, Tanaka et al.
U.S. Appl. No. 12/093,753, filed May 15, 2008, Oshige et al.
U.S. Appl. No. 12/094,198, filed May 19, 2008, Kato et al.
U.S. Appl. No. 11/856,304, filed Sep. 17, 2007, Oshige et al.

* cited by examiner

IMAGE FORMING APPARATUS AND TONER CONCENTRATION CONTROLLING METHOD

CROSS-REFERENCE TO RELATED APPLICATIONS

The present document incorporates by reference the entire contents of Japanese priority document, 2005-232659 filed in Japan on Aug. 10, 2005 and 2005-240446 filed in Japan on Aug. 22, 2005.

BACKGROUND OF THE INVENTION

1. Field of the Invention

The present invention generally relates to a technology for forming images, and particularly relates to forming images using a two-component developer.

2. Description of the Related Art

A two-component developing method has been known in which a two-component developer (hereinafter "developer") that contains a non-magnetic toner and a magnetic carrier is held on a developer holding member to form a magnetic brush by a magnetic pole inside the developer holding member, and a latent image formed on a latent image holding member is developed by the magnetic brush into an image. The two-component developing method is in widespread use because of the easy colorization. According to the two-component developing method, when toner concentration, i.e., the ratio (for example, weight ratio) of toner to magnetic carrier contained in the developer, is too high, an image may be smudged in the background or resolution may be lowered in detailed parts of the image. On the other hand, when the toner concentration is too low, the density of solid areas in the image may be lowered or carriers may adhere to the latent image holding member. Therefore, the toner concentration in a developer needs to be controlled and ensured to be always within an appropriate range in such a manner that the toner concentration is detected and the toner supply operation is controlled in a developing device.

Generally, the toner concentration is detected by the amount of toner or the number of magnetic carriers in a two-component developer present in a predetermined detection area in the developing device. A typical example of this method uses a magnetic permeability sensor (a detecting unit). The magnetic permeability sensor recognizes magnetic characteristics of magnetic carriers contained in a developer present in the predetermined detection area as an electric signal (frequency, voltage, etc), and outputs the electric signal. When the toner concentration is within a practical range, the output value of the magnetic permeability sensor monotonically decreases as the number of the magnetic carriers present in the detection area increases. Based on the output value, the toner concentration in the developer can be detected.

However, with the method described above, when there is a change in the bulk density of the developer in the detection or the fluidity of the developer, the output value of the magnetic permeability sensor also changes even if the toner concentration is unchanged. In such a situation, the toner concentration indicated by the output value of the magnetic permeability sensor is different from the actual toner concentration.

Japanese Patent Application Laid-open No. 2003-280355 discloses a conventional image forming apparatus that uses a magnetic permeability sensor to detect toner concentration in a developer in a developing device and compares the output value of the magnetic permeability sensor with a target output value, thereby controlling the toner concentration. The conventional image forming apparatus has image forming modes in each of which image forming is performed at a different process linear velocity. When the image forming mode is switched from one to another, the process linear velocity is changed, and the developer stirring/carrying speed in the developing device is also changed. Consequently, the number of magnetic carriers in the detection area of the magnetic permeability sensor per unit of time varies depending on the image forming mode. As a result, even if the toner concentration is unchanged, the output value of the magnetic permeability sensor varies depending on the image forming mode.

In the conventional image forming apparatus, the process linear velocity is set at a standard linear velocity in a warm-up period, and the toner concentration is controlled to an appropriate level at the standard linear velocity. In other words, the output value of the magnetic permeability sensor is controlled to a target output value. Subsequently, control voltages to be applied to the magnetic permeability sensor are set so that the output values for toner concentration levels each corresponding to one of the three image forming modes is the target output value, the three image forming modes being preset to have mutually different process linear velocities. When image forming is performed in one of the image forming modes, a control voltage corresponding to the image forming mode is applied to the magnetic permeability sensor, and the toner concentration is detected to control the toner concentration in a developer. With the conventional image forming apparatus performing such control, no matter in what image forming mode image forming is performed, it is possible to achieve the same output value of the magnetic permeability sensor as long as the toner concentration is the same.

According to the conventional technology described above, however, a developing device in which a two-component developer is used, and especially in a color image forming apparatus, an additive such as silica or titanium oxide is externally added to the surface of toner to improve the dispersion of the toner. Such an additive is easily affected by mechanical stress or thermal stress. During the stirring process in the developing device, the additive may be embedded in the toner or released from the toner surface. As a result, the fluidity or the charging characteristic of the developer changes, and the bulk density of the developer also changes.

In addition, in the course of time, due to a change in the shape of the magnetic carrier surface, accumulated external additives removed from toner, or a decrease in the chargeability of magnetic carrier (called "CA") due to peeling of a carrier coating film, the fluidity of the developer changes, and the bulk density of the developer also changes.

These changes prevent the magnetic permeability sensor from detecting the toner concentration accurately. For example, when an image forming apparatus has a plurality of image forming modes, and the developer stirring/carrying speed in the developing device varies depending on the image forming mode, the output value of the magnetic permeability sensor changes even if the toner concentration is unchanged as explained above. Further, the correction amount for the output value of the magnetic permeability sensor changes according to degradation or use status of a developer. Consequently, there has been a difficulty in accurately correcting the output value of the magnetic permeability sensor.

SUMMARY OF THE INVENTION

It is an object of the present invention to at least partially solve the problems in the conventional technology.

According to an aspect of the present invention, an image forming apparatus includes a developing device that applies a two-component developer containing toner and magnetic carrier to a latent image so that the toner adheres to the latent image and develops an image, a detection area being predetermined in the developing device, a stirring and carrying member that is located in the developing device, and stirs and carries the two-component developer in the detection area at different stirring and carrying speeds that correspond to a plurality of image forming modes including a first image forming mode and a second image forming mode, the stirring and carrying speeds including a reference stirring and carrying speed that corresponds to the first image forming mode, and a second stirring and carrying speed that corresponds to the second image forming mode, a detecting unit that detects magnetic carrier contained in the two-component developer in the detection area, and outputs, based on detected magnetic carrier, a reference output value when the two-component developer is stirred and carried at the reference stirring and carrying speed, and a second output value when the two-component developer is stirred and carried at the second stirring and carrying speed, and a controlling unit that performs an image forming process while switching the image forming modes, and controls toner concentration, for performing the image forming process in the first image forming mode, based on the reference output value, and controls the toner concentration, for performing the image forming process in the second image forming mode, based on a corrected output value obtained by correcting an output value of the detecting unit in the second image forming mode with a difference value between the reference output value and the second output value.

According to another aspect of the present invention, a toner concentration controlling method includes a developing device applying a two-component developer that contains a toner and a magnetic carrier to a latent image so that the toner adheres to a latent image and developing an image, a stirring and carrying member stirring and carrying the two-component developer in a predetermined detection area at different stirring and carrying speeds that correspond to a plurality of image forming modes including a first image forming mode and a second image forming mode, the stirring and carrying speeds including a reference stirring and carrying speed that corresponds to the first image forming mode, and a second stirring and carrying speed that corresponds to the second image forming mode, a detecting unit detecting the magnetic carrier contained in the two-component developer in the predetermined detection area, and outputting, based on the detected magnetic carrier, a reference output value when the two-component developer is stirred and carried at the reference stirring and carrying speed, and a second output value when the two-component developer is stirred and carried at the second stirring and carrying speed, performing an image forming process while switching the image forming modes, controlling toner concentration based on the reference output value for performing the image forming process in the first image forming mode, and controlling the toner concentration, for performing the image forming process in the second image forming mode, based on a corrected output value obtained by correcting an output value of the detecting unit in the second image forming mode with a difference value between the reference output value and the second output value.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
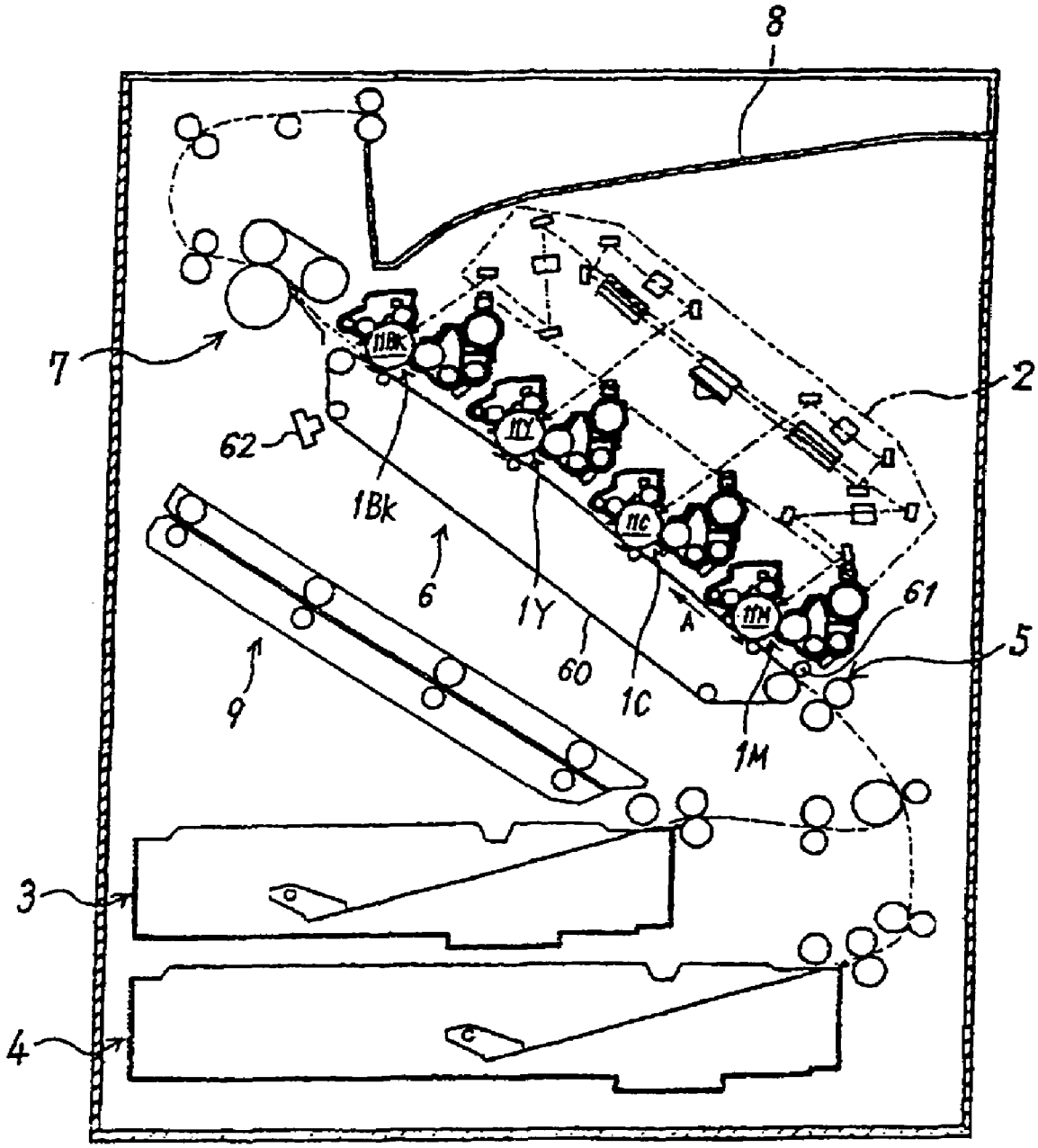
FIG. 1 is a schematic of a laser printer according to an embodiment of the present invention.

Exemplary embodiments of the present invention will be explained with reference to the accompanying drawings. In the following explanation, an image forming apparatus according to an embodiment of the present invention is applied to an electrophotographic color laser printer (hereinafter, "laser printer").

Japanese Patent Application Laid-open No. 2002-40794 discloses another conventional image forming apparatus than the one disclosed in Japanese Patent Application Laid-open No. 2003-280355. The conventional image forming apparatus also uses a magnetic permeability sensor to detect toner concentration in a developer of a developing device and compares the output value of the magnetic permeability sensor with a target output value, thereby controlling toner concentration in a developing device. In the conventional image forming apparatus, a correction value predetermined according to the image size ratio is added to or subtracted from the output value of the magnetic permeability sensor to control the toner concentration using the corrected output value. When an image having a high image size ratio is formed, the toner concentration of a developer used to develop the image is substantially reduced. Thus, in the developer, the chances that magnetic carriers contact toner increase, and the electric charge of the toner also increases. Consequently, repulsion between toner particles becomes stronger, and the void ratio in the developer increases. As a result, even with the same toner concentration, the output value of the magnetic permeability sensor is different from the one in the case of the ordinary amount of toner electric charge. With the conventional image forming apparatus, the output value of the magnetic permeability sensor is corrected using the correction value according to the image size ratio, and the toner concentration control is exercised appropriately.

The image forming apparatus disclosed in Japanese Patent Application Laid-open No. 2003-280355 is capable of inhibiting changes in the output value of the magnetic permeability sensor caused by changes in the image forming mode (changes in developer stirring/carrying speed), but cannot inhibit changes in the output value of the magnetic permeability sensor caused by changes in the image size ratio of a formed image. On the other hand, the image forming apparatus disclosed in Japanese Patent Application Laid-open No. 2002-40794 is capable of inhibiting changes in the output value of the magnetic permeability sensor caused by changes in the image size ratio of a formed image, but cannot inhibit changes in the output value of the magnetic permeability sensor caused by changes in the image forming mode (changes in developer stirring/carrying speed). Thus, there is a need of a technology capable of inhibiting changes in the output value of the magnetic permeability sensor caused by changes in the image forming mode (changes in developer stirring/carrying speed) as well as inhibiting changes in the output value of the magnetic permeability sensor caused by changes in the image size ratio of a formed image.

The output value of the magnetic permeability sensor changes in correspondence with the close relationship between the developer stirring/carrying speed and the image size ratio.

To be more specific, for example, when images having a high image size ratio are formed in series in a low-speed mode in which the developer stirring/carrying speed is low, a large amount of toner is supplied to the developer with a low stirring/carrying speed while the images are being formed in series. In such a situation, the toner cannot be electrically charged sufficiently because the developer to which the toner has been supplied cannot be stirred sufficiently. Consequently, repulsion between toner particles is smaller than the one in the case of the ordinary amount of toner electric charge, and thus the bulk density of the developer increases. As a result of the image forming process during the period in which the images are formed in series, the toner concentration indicated by the output value of the magnetic permeability sensor deviates toward lower values than the actual toner concentration. When the toner concentration is controlled according to the output value of the magnetic permeability sensor, the actual toner concentration exceeds the target toner concentration.

Conversely, for example, when images having a low image size ratio are formed in series in a high-speed image forming mode in which the developer stirring/carrying speed is high, a small amount of toner is supplied to the developer with a high stirring/carrying speed, while the images are being formed in series. In such a situation, the electric charge of the toner excessively increases because the developer to which the toner has been supplied is stirred too much. Consequently, repulsion between toner particles is larger than the one in the case of the ordinary amount of toner electric charge, and thus the bulk density of the developer decreases. As a result of the image forming process during the period in which the images are formed in series, the toner concentration indicated by the output value of the magnetic permeability sensor deviates toward higher values than the actual toner concentration. When the toner concentration is controlled according to the output value of the magnetic permeability sensor, the actual toner concentration becomes lower than the target toner concentration.

When images having mutually different image size ratios are formed, developer portions used to develop the images have mutually different toner concentration levels. Thus, the state in which magnetic carriers contact the toner is different in each developer portion. The difference in the state not only causes the electric charge of the toner to be different from one another, but also causes fluidity of the developer to be different from one another. In other words, when images having mutually different image size ratios are formed, developer portions used to develop the images have mutually different fluidity levels. Consequently, because the number of magnetic carriers in the developer portion that pass through a detection area in the magnetic permeability sensor per unit of time changes, the number of magnetic carriers present in the detection area in the magnetic permeability sensor per unit of time also changes. Accordingly, when the images having mutually different image size ratios are formed, the output values from the magnetic permeability sensor are mutually different even with the same toner concentration. This also indicates that the output value of the magnetic permeability sensor changes in correspondence with the close relationship between the developer stirring/carrying speed and the image size ratio.

With a laser printer (an image forming apparatus) according to an embodiment of the present invention, it is possible to prevent the situation where the toner concentration indicated by an output value of the magnetic permeability sensor deviates from the actual toner concentration because of the close relationship between the developer stirring/carrying and the image size ratio. In the following, the laser printer according to the embodiment will be explained in detail.

FIG. 1 is a schematic of the laser printer according to the embodiment. The laser printer includes four image forming units 1M, 1C, 1Y, and 1BK, that form images in colors of magenta (M), cyan (C), yellow (Y) and black (BK), respectively(hereinafter, the letters M, C, Y, and BK attached to reference characters indicate that the members being referred to correspond to the colors magenta, cyan, yellow, and black, respectively). The image forming units 1M, 1C, 1Y, and 1BK are arranged in this order from the upstream side of the movement direction (the direction indicated by the arrow A in FIG. 1) of a transfer paper P (see FIG. 2) that serves as a recording member. The image forming units 1M, 1C, 1Y, and 1BK each includes a photosensitive member unit having a photosensitive member in the form of a drum (11M, 11C, 11Y, and 11BK) and a developing device. The image forming units 1M, 1C, 1Y, and 1BK are arranged at a predetermined pitch in the movement direction of transfer papers such that the rotation axes of the photosensitive members 11M, 11C, 11Y, and 11BK in the photosensitive member units are positioned parallel to one another.

In addition to the image forming units 1M, 1C, 1Y, and 1BK, the laser printer includes an optical writing unit 2, paper feeding cassettes 3 and 4, a transfer unit 6, a resist roller 5, a fixing unit 7 that uses a belt fixing method, a paper ejection tray 8, and a reversal unit 9. The transfer unit 6 includes a transfer belt 60 that transports the transfer paper P toward transfer members respectively opposing the photosensitive members 11M, 11C, 11Y, and 11BK. The resist roller 5 includes a pair of rollers to feed the transfer paper P to the transfer belt 60. Further, the laser printer includes a manual-feed paper tray, a toner supply container, a waste toner bottle, a power supply unit (not shown).

The optical writing unit 2 includes a light source, a polygon mirror, an f-θ lens, and a reflection mirror. The optical writing unit 2 scans laser beams and irradiates the surfaces of the photosensitive members 11M, 11C, 11Y, and 11BK according to image data.

The dot-and-dash line in FIG. 1 indicates the conveying path for the transfer paper P. The transfer paper P fed from one of the paper feeding cassettes 3 and 4 is conveyed by a conveyor roller while being guided by a transport guide (not shown), and forwarded to the temporary stopping position at which the resist roller 5 is located. The transfer paper P is supplied to the transfer belt 60 by the resist roller 5 at predetermined timing and conveyed so that the transfer paper P passes through the transfer members that oppose the photosensitive members 11M, 11C, 11Y, and 11BK. Thus, the toner images formed on the photosensitive members 11M, 11C, 11Y, and 11BK by the image forming units 1M, 1C, 1Y, and 1BK are transferred onto the transfer paper, by being sequentially superimposed, so that a color image is formed on the transfer paper. The transfer paper P on which the color image has been formed then has the toner images fixed by the fixing unit 7 before being ejected onto the paper ejection tray 8.

Figure 2:
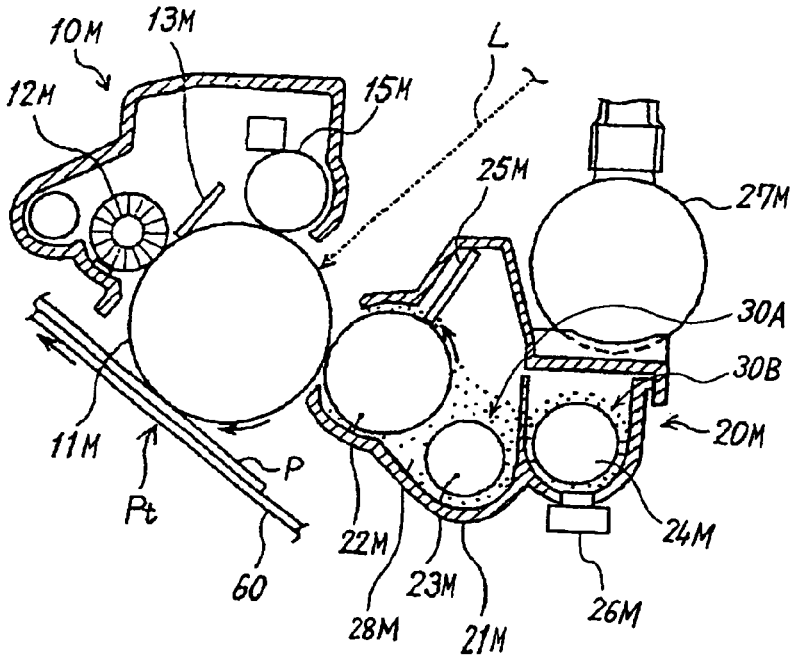
FIG. 2 is an enlarged view of a magenta image forming unit shown in FIG. 1.

FIG. 2 is an enlarged view of the magenta image forming unit 1M that is one of the image forming units 1M, 1C, 1Y, and 1BK. The image forming units 1C, 1Y, and 1BK have the same configuration as the image forming unit 1M, and the explanation thereof will be omitted.

The image forming unit 1M includes a photosensitive member unit 10M and a developing device 20M. In addition to the photosensitive member 11M, the photosensitive member unit 10M includes a cleaning blade 13M capable of oscillating movement and cleans the surface of the photosensitive member 11M, and a charger roller 15 that is of a non-contact type and electrically charges the surface of the photosensitive member 11M uniformly. The photosensitive member unit 10M also includes a lubricant-applying and static-eliminating brush roller 12M for applying a lubricant to the surface of the photosensitive member and eliminating static electricity from the surface of the photosensitive member. The lubricant-applying and static-eliminating brush roller 12M includes the brush portion formed of conductive fibers, and core metal portion connected to a static-eliminating power supply (not shown) to apply static-eliminating bias. Incidentally, allow L indicates irradiation light or a laser beam corresponding to image information.

In the photosensitive member unit 10M, the surface of the photosensitive member 11M is electrically charged uniformly by the charger roller 15M to which a voltage has been applied. When the surface of the photosensitive member 11M is scanned and irradiated with the laser beam that has been modulated and deflected by the optical writing unit 2, an electrostatic latent image is formed on the surface of the photosensitive member 11M. The electrostatic latent image on the photosensitive member 11M is developed by the developing device 20M to be a magenta toner image. When the transfer paper P on the transfer belt 60 passes through a transfer member Pt, the toner image on the photosensitive member 11M is transferred onto the transfer paper P. After the toner image is transferred to the transfer paper P, a predetermined amount of lubricant is applied to, and static electricity is eliminated from, the surface of the photosensitive member 11M by the lubricant-applying and static-eliminating brush roller 12M. The surface of the photosensitive member 11M is then cleaned by the cleaning blade 13M to be prepared for the next electrostatic latent image forming process.

As a developer for developing the electrostatic latent image, the developing device 20M uses a two-component developer (hereinafter, "the developer") 28M that contains a magnetic carrier and a negatively-charged toner. The developing device 20M includes a developing case 21M, a developing sleeve 22M, a magnet roller (not shown), stirring/carrying screws 23M and 24M, a developing doctor 25M, a magnetic permeability sensor 26M, and a powder pump 27M. The developing sleeve 22M is made of a non-magnetic material and is arranged with a part being exposed from an opening in the developing case 21M on the photosensitive member side thereof. The magnet roller is fixed inside the developing sleeve 22M as a magnetic field generating unit. The magnetic permeability sensor 26M detects the magnetic permeability of the developer 28M as a toner concentration sensor. A developing bias voltage obtained by superimposing an alternating current voltage AC (alternating current component) onto a negative direct current voltage DC (direct current component) is applied to the developing sleeve 22M by a developing bias power supply (not shown). Thus, the developing sleeve 22M is biased to a predetermined voltage with respect to a metal base layer in the photosensitive member 11M.

The developer 28M in the developing case 21M is stirred and transported by the stirring/carrying screws 23M and 24M, and thus the toner is electrically charged by friction. A portion of the developer 28M in a first stirring/carrying path 30A is held on the surface of the developing sleeve 22M. After the thickness of the layer is regulated by the developing doctor 25M, the portion of the developer 28M is transported to a developing area that opposes the photosensitive member 11M. In the developing area, the toner contained in the developer on the developing sleeve 22 adheres to the electrostatic latent image formed on the photosensitive member 11M due to the development field to form a toner image. Subsequently, the developer passes through the developing area and recedes from the developing sleeve 22M at a developer separation pole on the developing sleeve 22M and returns to the first stirring/carrying path 30A. The developer 28M is transported on the first stirring/carrying path 30A to the downstream end thereof, and moves to the upstream end of a second stirring/carrying path 30B. The developer 28M is then supplied with toner on the second stirring/carrying path 30B. Subsequently, the developer 28M is transported on the second stirring/carrying path 30B to the downstream end thereof, and moves to the upstream end of the first stirring/carrying path 30A. The magnetic permeability sensor 26M is located at the developing case portion that constitutes the bottom of the second stirring/carrying path 30B.

Because the toner concentration of the developer 28M inside the developing case 21M decreases due to the toner consumption in the image forming process, some toner is supplied from a toner cartridge (not shown) by the powder pump 27M according to the output value Vt of the magnetic permeability sensor 26M so that the toner concentration is maintained constant. The toner supply control is exercised based on a difference value Tn ($Tn=Vt_{ref}-Vt$) between an output value Vt and a target output value $Vt_{ref}$. When the difference value Tn is positive, it is judged that the toner concentration is high enough, and no toner is supplied. When the difference value Tn is negative, toner is supplied so that the output value Vt becomes close to the target output value $Vt_{ref}$ by supplying the larger amount of toner for the larger absolute value of the difference value Tn. The details of the toner supply control will be explained later.

Every time the number of sheets on which images have been formed has reached 10 (or may be approximately 5 to 200, depending on the copying speed or the like), the target output value $Vt_{ref}$, the electric charge potential, and the amount of light are adjusted through process control. To be more specific, for example, the density of a plurality of half-tone patterns and solid patterns that have been formed on the photosensitive member 11M are detected by a reflection density sensor 62. A toner adhesion amount is obtained based on the detected value. The target output value $Vt_{ref}$, the electric charge potential, and the amount of light are adjusted so that the toner adhesion amount becomes a target adhesion amount.

Out of the four photosensitive members 11M, 11C, 11Y, and 11BK, the photosensitive member 11BK for black positioned on the farthest downstream side is the only one that is in a transfer nip constant-contact state, i.e., the photosensitive member 11BK is always in contact with the transfer belt 60. The other photosensitive members 11M, 11C, and 11Y can be in and out of contact with the transfer belt 60.

Next, the image forming operation performed by the laser printer according to the embodiment will be explained.

When a color image is to be formed on the transfer paper P, each of the four photosensitive members 11M, 11C, 11Y, and 11BK contact the transfer belt 60. An electric charge with a polarity the same as that of toner is applied to the transfer paper P by an electrostatic absorption roller 61 so that the transfer paper P adheres to the transfer belt 60. Thus, it is possible to avoid the problem that the toner image cannot be transferred properly due to a charge-up of the transfer paper P. The transfer paper P is transported while adhering to the transfer belt 60. The toner images in colors of magenta, cyan, yellow, and black that have been formed on the photosensitive members 11M, 11C, 11Y, and 11BK are sequentially transferred to be superimposed on top of one another. The toner images that have been transferred and superimposed on the transfer paper P are fixed by the fixing unit 7, and thus a full-color image is formed on the transfer paper P.

As another example, when a monochrome image in black is to be formed on the transfer paper P, the photosensitive members 11Y, 11C, and 11M are taken away from the transfer belt 60 so that only the photosensitive member 11BK, with which a black toner image is formed, contacts the transfer belt 60. The transfer paper P is supplied to the transfer nip of the photosensitive member 11BK. After the black toner image is transferred, the toner image is fixed by the fixing unit 7, and thus a monochrome image in black is formed on the transfer paper P.

Figure 3:
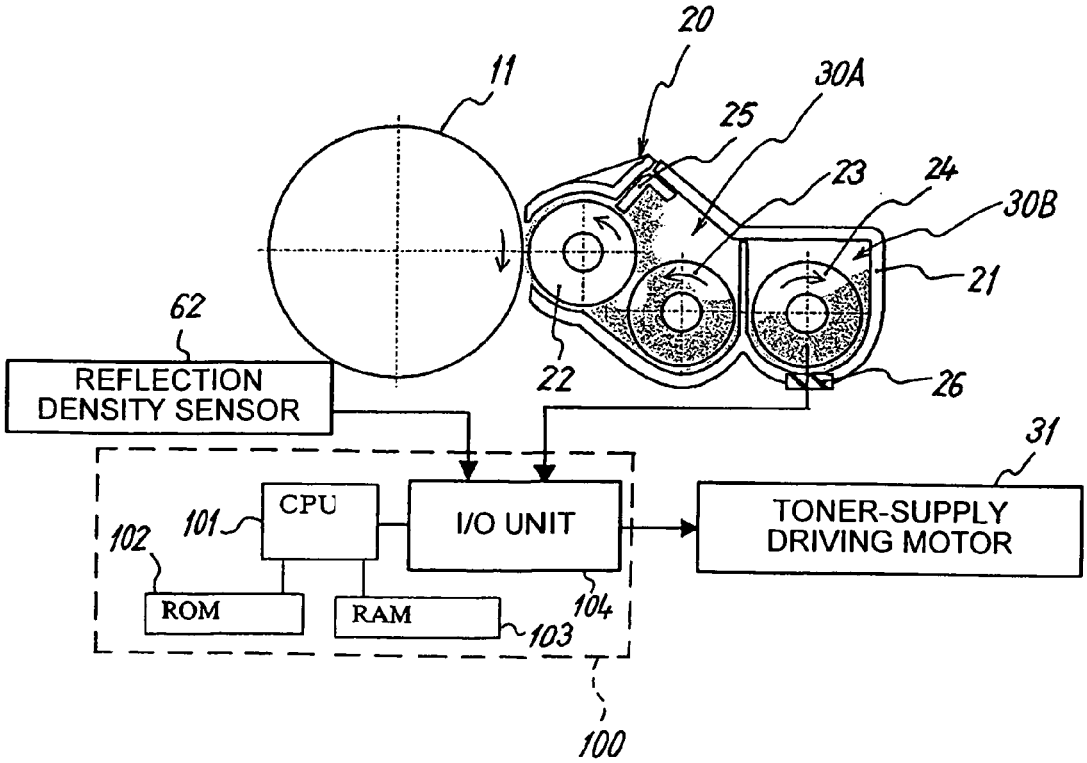
FIG. 3 is a diagram of a controlling unit of the laser printer shown in FIG. 1.

FIG. 3 is a diagram of a controlling unit 100 that exercises the toner concentration control. The controlling unit 100 is provided in each developing device. The basic configuration is the same for all of them, and the color reference symbols (Y, C, M, and BK) will be omitted in the following explanation. Some components of the controlling units 100, e.g., central processing unit (CPU), read only memory (ROM), and random access memory (RAM), in the developing devices are shared among the developing devices.

The controlling unit 100 includes a CPU 101, a ROM 102, a RAM 103, an input/output (I/O) unit 104. The magnetic permeability sensor 26 and the reflection density sensor 62 are each connected to the I/O unit 104 via an analog-to-digital (A/D) converter (not shown). According to a predetermined toner concentration control program that is executed by the CPU 101, the controlling unit 100 transmits a control signal to a toner-supply driving motor 31 that drives the powder pump 27 via the I/O unit 104 to control the toner supply operation. The ROM 102 stores therein the toner concentration control program, a difference-value adjustment program, an image density control parameter correction program, and the like that are executed by the CPU. The RAM 103 includes a Vt register that temporarily stores therein an output value Vt of the magnetic permeability sensor 26 obtained via the I/O unit 104, a ΔVt register that stores therein difference values $\Delta Vt_1$ and $\Delta Vt_2$, a $Vt_{ref}$ register that stores therein a reference output value $Vt_{ref}$ that is to be output from the magnetic permeability sensor 26 when the toner concentration of the developer in the developing device 20 is the target toner concentration, and a Vs register that stores therein an output value Vs of the reflection density sensor 62.

Next, the toner supply control will be explained in detail.

Figure 4:
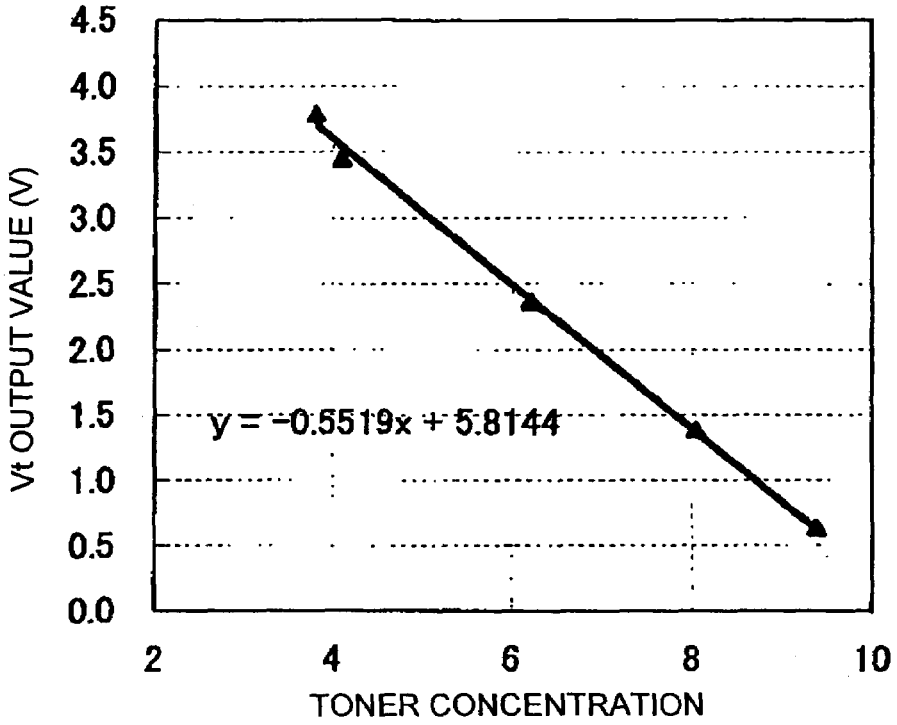
FIG. 4 is a graph of the relationship between the output value of a magnetic permeability sensor shown in FIG. 3 and the toner concentration in a developer.

FIG. 4 is a graph of the relationship between the output value of the magnetic permeability sensor 26 and the toner concentration in a developer, in which the vertical axis indicates the output value of the magnetic permeability sensor 26, and the horizontal axis indicates the toner concentration in the developer.

As shown in the graph, when the toner concentration is within a practical range, the relationship between the output value of the magnetic permeability sensor 26 and the toner concentration in a developer can be in a collinear approximation. In addition, such characteristic is indicated that the higher the toner concentration in the developer is, the smaller the output value of the magnetic permeability sensor 26 is. Using this characteristic, when the output value Vt of the magnetic permeability sensor 26 is larger than the control reference value $Vt_{ref}$, the powder pump 27 is driven to supply toner. In the embodiment, every time an image forming process is performed, the toner supply control is exercised based on the output value Vt of the magnetic permeability sensor 26.

The laser printer has a plurality of image forming modes that have mutually different process linear velocities. According to the embodiment, the laser printer has three image forming modes. The process linear velocity in the standard mode, which is a reference image forming mode, is 205 millimeters per second (mm/s). The process linear velocity in the medium speed mode, which is a non-reference image forming mode, is 115 mm/s. The process linear velocity in the low speed mode, which is a non-reference image forming mode, is 77 mm/s. In the laser printer, the driving speed of the stirring/carrying screws 23M and 24M in the developing device 20 is also changed according to the change in the process linear velocity. That is, the developer stirring/carrying in the developing device 20 becomes lower in the order of the standard mode, the medium speed mode, and the low speed mode.

Figure 5:
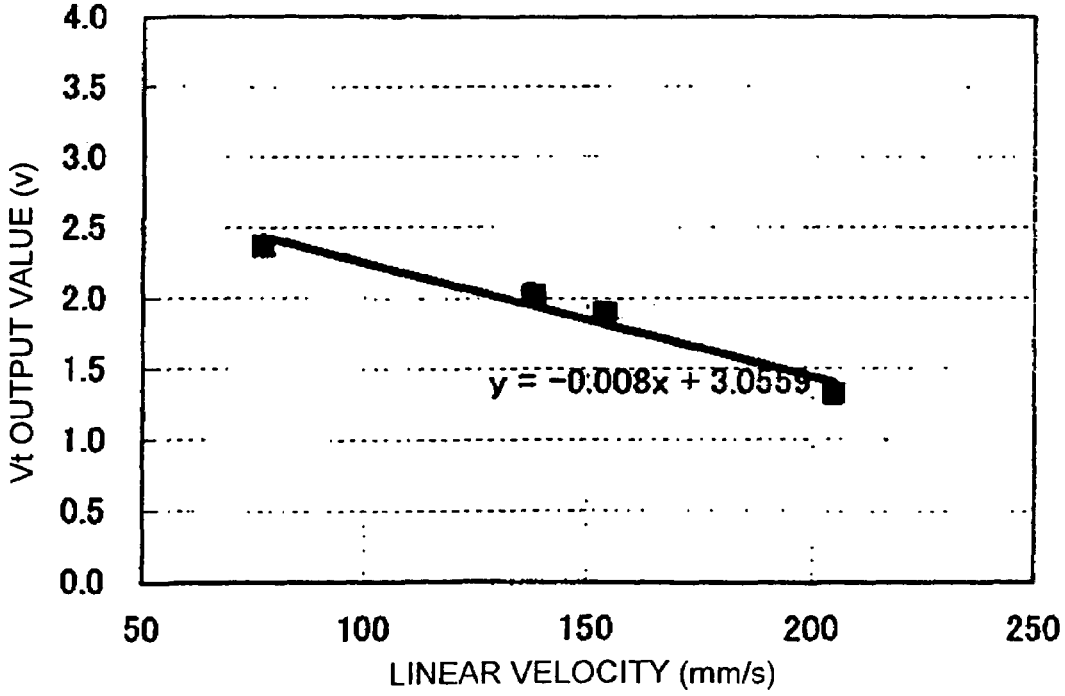
FIG. 5 is a graph of the relationship between the output value of the magnetic permeability sensor and the process linear velocity with respect to a developer having the same toner concentration.

FIG. 5 is a graph for explaining the result of an experiment in which the output value of the magnetic permeability sensor 26 is measured, using a developer having the same toner concentration, while the process linear velocity (developer stirring/carrying speed) is changed. As observed from the graph, even if the toner concentration is unchanged, when the process linear velocity is changed, the output value Vt of the magnetic permeability sensor 26 changes. To be more specific, the lower the process linear velocity is, the larger the output value of the magnetic permeability sensor 26 is. This is because the developer stirring/carrying speed is changed when the process linear velocity is changed, and the apparent number of magnetic carriers that are present in the detection area in the magnetic permeability sensor 26 per unit of time also changes.

As understood from the result of the experiment, even if the toner concentration is unchanged, the output value Vt of the magnetic permeability sensor 26 varies depending on the image forming mode. Consequently, in this situation, it is not possible to control the toner concentration properly in each of the image forming modes. To cope with this situation, according to the embodiment, the output value $Vt_0$ of the magnetic permeability sensor 26 is corrected in the medium speed mode and the low speed mode, and the toner concentration is controlled using the corrected output value Vt obtained by the correction. When the standard mode is used, no such correction is performed because the target reference value $Vt_{ref}$ is set on the basis of the process linear velocity in the standard mode.

Figure 6:
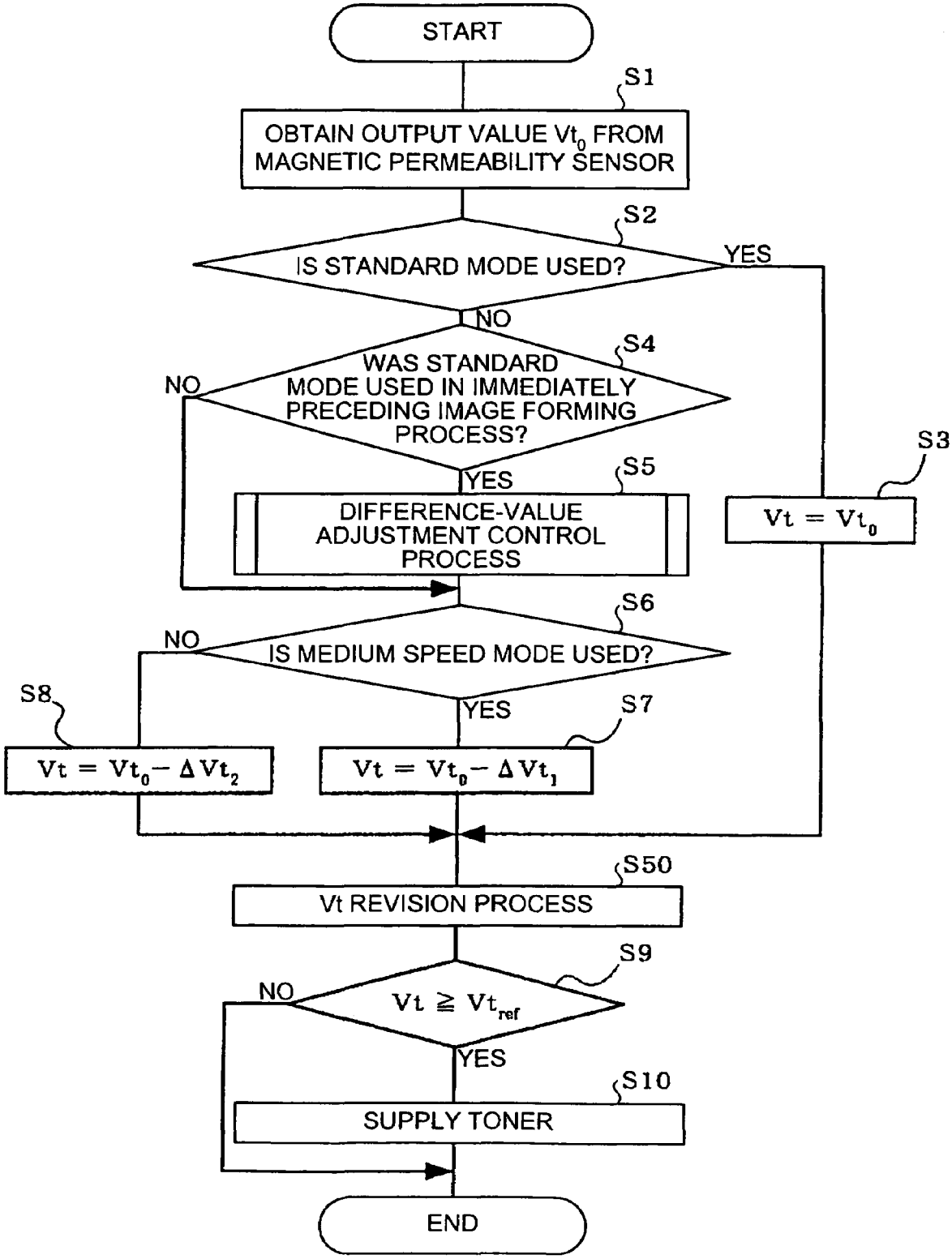
FIG. 6 is a flowchart of basic toner concentration control in the laser printer.

FIG. 6 is a flowchart of the basic toner concentration control according to the embodiment.

Having received a print instruction, the CPU 101 of the controlling unit 100 reads the toner concentration control program from the ROM 102, and executes the program to obtain the output value $Vt_0$ of the magnetic permeability sensor 26 (step S1). In the following explanation, the output value itself (meta-output value) of the magnetic permeability sensor 26 is expressed as $Vt_0$, whereas the output value used for the toner supply operation is expressed as Vt. Subsequently, it is judged whether the image forming mode related to the print instruction is the standard mode (step S2). When the standard mode is to be used (Yes at step S2), the meta-output value $Vt_0$ of the magnetic permeability sensor 26 is stored, as the output value Vt, in the Vt register of the RAM 103 (step S3). On the other hand, the standard mode is not to be used (No at step S2), the CPU 101 reads the image forming mode used in the immediately preceding image forming process, and judges whether the image forming mode was the standard mode (step S4). When the standard mode was used, a difference value-correction control process is performed (step S5). The difference-value correction control process will be described later. The process at steps S4 and S5 does not necessarily have to be performed.

Next, the CPU 101 of the controlling unit 100 judges whether the image forming mode related to the print instruction is the medium speed mode (step S6). When the medium speed mode is to be used, the CPU 101 reads the difference value $\Delta Vt_1$ corresponding to the medium speed mode, which has been calculated in advance, out of the ΔVt register in the RAM 103. The CPU 101 then subtracts the difference value $\Delta Vt_1$ from the meta-output value $Vt_0$ of the magnetic permeability sensor 26, and stores the calculation result, as the output value Vt, in the Vt register of the RAM 103 (step S7). The difference value $\Delta Vt_1$ indicates the difference with respect to a developer having the same toner concentration between the output value of the magnetic permeability sensor operating at a process linear velocity in the standard mode and the output value of the magnetic permeability sensor operating at a process linear velocity in the medium speed mode.

On the other hand, when the image forming mode related to the print instruction is not the medium speed mode, i.e., the image forming mode is the low speed mode, the CPU 101 reads the difference value $\Delta Vt_2$ corresponding to the low speed mode, which has been calculated in advance by the controlling unit 100, out of the ΔVt register in the RAM 103. The CPU 101 then subtracts the difference value $\Delta Vt_2$ from the meta-output value $Vt_0$ of the magnetic permeability sensor 26, and stores the calculation result, as the output value Vt, in the Vt register of the RAM 103 (step S8). The difference value $\Delta Vt_2$ indicates the difference with respect to a developer having the same toner concentration between the output value of the magnetic permeability sensor operating at a process linear velocity in the standard mode and the output value of the magnetic permeability sensor operating at a process linear velocity in the low speed mode.

In this manner, the output value of the magnetic permeability sensor 26 is corrected according to the image forming mode (the process linear velocity). The CPU 101 of the controlling unit 100 then reads the output value Vt out of the Vt register in the RAM 103. Subsequently, the CPU 101 performs a Vt revision process on the output value Vt that has been read (step S50). After that, the CPU 101 reads the target output value $Vt_{ref}$ out of the $Vt_{ref}$ register, and compares the output value Vt that has been corrected in the Vt revision process with the target output value $Vt_{ref}$ (step S9). When the output value Vt is equal to or larger than the target output value $Vt_{ref}$, the CPU 101 outputs a drive instruction to the toner-supply driving motor 31 via the I/O unit 104 to supply an amount of toner that corresponds to the difference between the output value Vt and the target output value $Vt_{ref}$. Consequently, the amount of toner that corresponds to the drive instruction is supplied from the powder pump 27 to the developing device 20 (step S10). On the other hand, when the output value Vt is smaller than the target output value $Vt_{ref}$, the CPU 101 ends the toner concentration control process.

Next, the difference-value adjustment control process (step S5) to adjust the difference values $\Delta Vt_1$ and $\Delta Vt_2$ that are used in the toner concentration control process in the medium speed mode and in the low speed mode will be explained.

As explained above, the difference values $\Delta Vt_1$ and $\Delta Vt_2$ each indicate the difference with respect to a developer having the same toner concentration between the output value of the magnetic permeability sensor operating at a process linear velocity in the standard mode and the output value of the magnetic permeability sensor operating at a process linear velocity in the medium speed mode or in the low speed mode. Even if the difference values $\Delta Vt_1$ and $\Delta Vt_2$ are appropriate values at the beginning, they deviate from the appropriate values while the image forming process is performed repeatedly. As a result, if the difference values $\Delta Vt_1$ and $\Delta Vt_2$ are fixed values, even if the corrected output value Vt that has been corrected by subtracting the difference value $\Delta Vt_1$ from the meta-output value $Vt_0$ is used to control the toner concentration in the medium speed mode, the corrected output value Vt will deviate from the meta-output value $Vt_0$ in the standard mode in course of time. As a result, in the toner concentration control process in the medium speed mode, the target toner concentration cannot be achieved. The same is true with the low speed mode.

To cope with this situation, according to the embodiment, the difference values are adjusted in the following manner.

Figure 7:
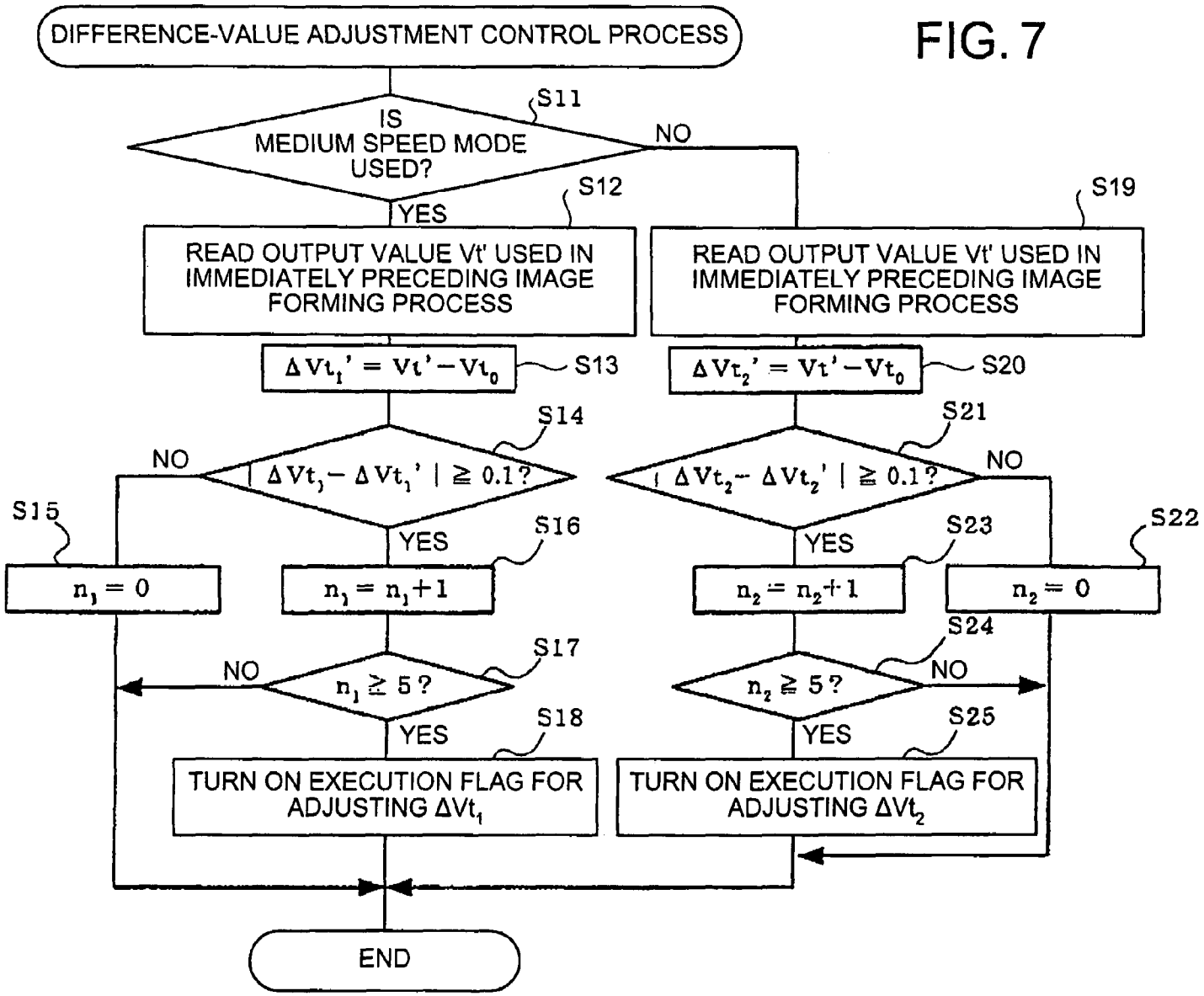
FIG. 7 is a detailed flowchart of an example of a difference-value adjustment control process shown in FIG. 6.

FIG. 7 is a detailed flowchart of the difference-value adjustment control process.

According to the embodiment, when the image forming mode used in the current image forming process is different from that used in the immediately preceding image forming process, the difference-value adjustment control process is performed. To be more specific, when the image forming mode used in the immediately preceding image forming process was the standard mode, and the image forming mode used in the current image forming process is not the standard mode, i.e., the medium speed mode or the low speed mode is used, (steps S2 and S4), the difference-value adjustment control process is performed.

First, the CPU 101 of the controlling unit 100 reads the difference-value adjustment program from the ROM 102 and executes the program. Based on a print instruction, the CPU 101 judges whether the current image forming mode is the medium speed mode (step S11). When the medium speed mode is used, the CPU 101 reads the previous output value Vt' used in the immediately preceding image forming process (step S12). At this time, because the output value used in the immediately preceding image forming process is still stored in the Vt register in the RAM 103, this output value is read as the previous output value Vt'. The previous output value Vt' is the output value of the magnetic permeability sensor 26 in the standard mode. The CPU 101 then calculates the difference value $\Delta Vt_1'$ between the previous output value Vt' and the current output value, that is, the output value $Vt_0$ (the output value in the medium speed mode) obtained at step S1 (step S13). The toner concentration in the developer is almost the same for the immediately preceding image forming process and for the current image forming process; therefore, the calculated difference value $\Delta Vt_1'$ is the latest difference value indicating the difference with respect to a developer having the same toner concentration between the output value of the magnetic permeability sensor operating at a process linear velocity in the standard mode and the output value of the magnetic permeability sensor operating at a process linear velocity in the medium speed mode.

When the latest difference value $\Delta Vt_1'$ has been calculated in this way, the CPU 101 reads the difference value $\Delta Vt_1$ that has so far been used out of the ΔVt register in the RAM 103. The CPU 101 then judges whether the absolute value of the difference between the difference value $\Delta Vt_1$ that has so far been used and the latest difference value $\Delta Vt_1'$ is equal to or larger than 0.1 volt (step S14). If the absolute value is smaller than 0.1 volt, the CPU 101 resets a counter value $n_1$ stored in the RAM 103 to zero (step S15), and ends the process. On the other hand, if the absolute value is equal to or larger than 0.1 volt, the CPU 101 adds 1 to the counter value $n_1$ stored in the RAM 103 (step S16). Then, the CPU 101 judges whether the counter value $n_1$ is equal to or larger than 5 (step S17). When the counter value $n_1$ is smaller than 5, the CPU 101 ends the process. On the other hand, when the counter value $n_1$ is equal to or larger than 5, the CPU 101 turns on an execution flag for adjusting the difference value $\Delta Vt_1$ (step S18). Thus, the adjustment process for the difference value $\Delta Vt_1$ will be executed later at predetermined timing.

On the other hand, when the medium speed mode is not used (No at step S11), in other words, when the low speed mode is used, the CPU 101 reads the previous output value Vt' that was used in the immediately preceding image forming process (step S19). The CPU 101 then calculates the difference value $\Delta Vt_2'$ between the previous output value Vt' and the current output value, that is, the output value $Vt_0$ obtained at step S1 (step S20). The toner concentration in the developer is almost the same for the immediately preceding image forming process and for the current image forming process; therefore, the calculated difference value $\Delta Vt_2'$ is the latest difference value indicating the difference with respect to a developer having the same toner concentration between the output value of the magnetic permeability sensor operating at a process linear velocity in the standard mode and the output value of the magnetic permeability sensor operating at a process linear velocity in the low speed mode.

When the latest difference value $\Delta Vt_2'$ has been calculated in this way, the CPU 101 reads the difference value $\Delta Vt_2$ that has so far been used out of the ΔVt register in the RAM 103. The CPU 101 then judges whether the absolute value of the difference between the difference value $\Delta Vt_2$ that has so far been used and the latest difference value $\Delta Vt_2'$ is equal to or larger than 0.1 volt (step S21). If the absolute value is smaller than 0.1 volt, the CPU 101 resets a counter value $n_2$ stored in the RAM 103 to zero (step S22), and ends the process. On the other hand, if the absolute value is equal to or larger than 0.1 volt, the CPU 101 adds 1 to the counter value $n_2$ stored in the RAM 103 (step S23). Then, the CPU 101 judges whether the counter value $n_2$ is equal to or larger than 5 (step S24). When the counter value $n_2$ is smaller than 5, the CPU 101 ends the process. On the other hand, when the counter value $n_2$ is equal to or larger than 5, the CPU 101 turns on an execution flag for adjusting the difference value $\Delta Vt_2$ (step S25). Thus, the adjustment process for the difference value $\Delta Vt_2$ will be executed later at predetermined timing.

According to the embodiment, the difference-value adjustment control process is performed when the image forming mode is changed from the standard mode to another mode; however, the present invention is not so limited. For example, the difference-value adjustment control process can be performed when the accumulated number of formed images reaches a predetermined number, or when the developing device is replaced with a new one, or when the developer is replaced.

In addition, the difference-value adjustment process, which is described later, is performed when the condition is satisfied that the difference between the difference value that has so far been used and the latest difference value is equal to or larger than 0.1 volt as a threshold value five times in a row; however, the present invention is not so limited. The condition can be changed, as necessary, while the response in the control process or the like is taken into account. In particular, the threshold value and the number of times can be changed according to various conditions under which the laser printer is operated.

Figure 8:
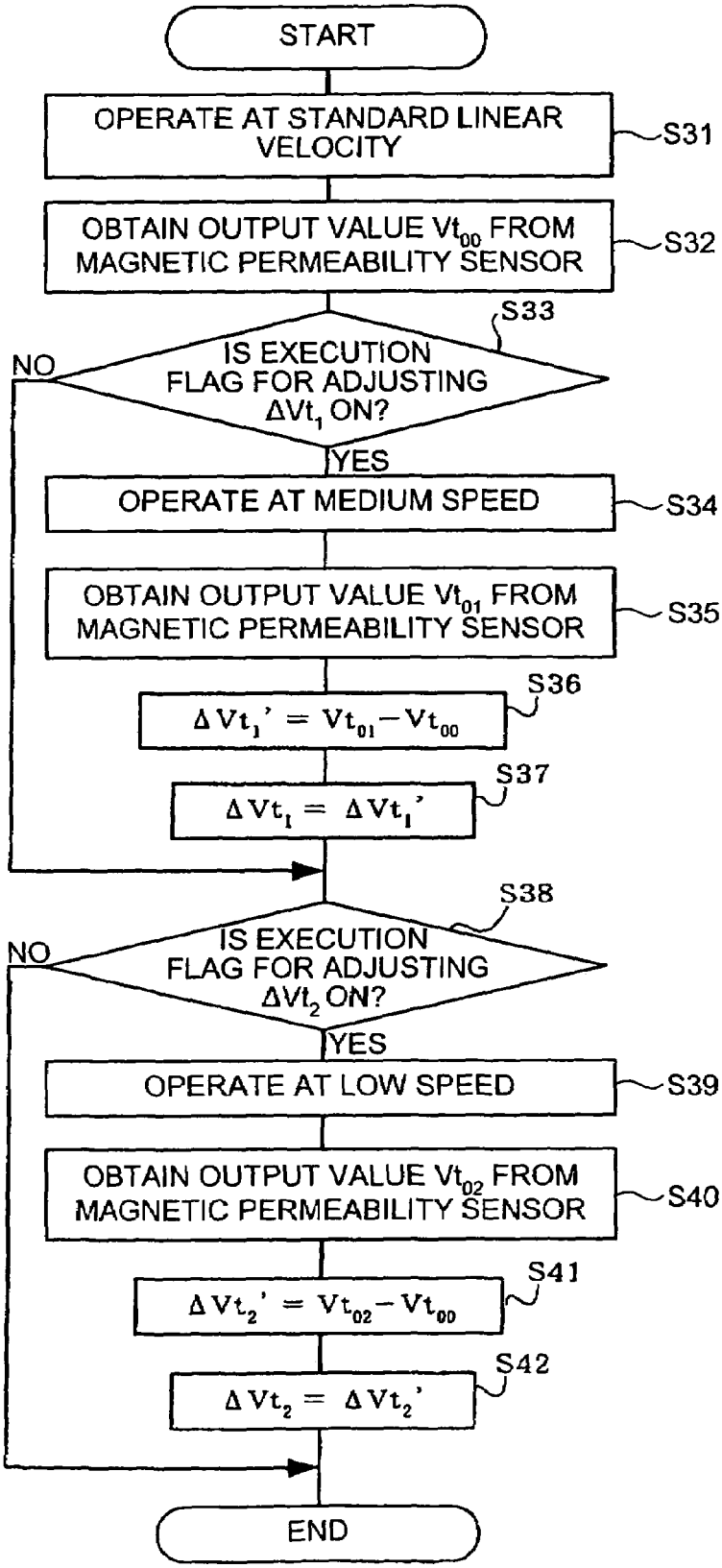
FIG. 8 is a flowchart of a difference-value adjustment process in the laser printer.

FIG. 8 is a flowchart of the difference-value adjustment process.

According to the embodiment, the difference-value adjustment process is performed during a warm-up period or a process control period. To be more specific, first, the CPU 101 of the controlling unit 100 causes the laser printer to operate at a process linear velocity that is the same as the one used in the standard mode (at a standard linear velocity) (step S31). The developer is stirred and transported by the stirring/carrying screws 23 and 24 in the developing device 20. Then, the CPU 101 obtains the output value (a standard output value) $Vt_{00}$ of the magnetic permeability sensor 26 at this time (step S32). Next, the CPU 101 judges whether the execution flag for adjusting the difference value $\Delta Vt_1$ is on (step S33). When the flag is on, the CPU 101 causes the laser printer to operate at a process linear velocity that is the same as the one used in the medium speed mode (at a medium speed) (step S34). Then, the CPU 101 obtains the output value (a medium speed output value) $Vt_{01}$ of the magnetic permeability sensor 26 at this time (step S35). Subsequently, the CPU 101 calculates a difference value (an adjustment difference value) $\Delta Vt_1'$ between the medium speed output value $Vt_{01}$ and the standard output value $Vt_{00}$ (step S36). The CPU 101 then updates the difference value $\Delta Vt_1$ stored in the ΔVt register of the RAM 103 with the adjustment difference value $\Delta Vt_1'$ (step S37).

Next, the CPU 101 judges whether the execution flag for adjusting the difference value $\Delta Vt_2$ is on (step S38). When the flag is on, the CPU 101 causes the laser printer to operate at a process linear velocity that is the same as the one used in the low speed mode (at a low speed) (step S39). Then, the CPU 101 obtains the output value (a low speed output value) $Vt_{02}$ of the magnetic permeability sensor 26 at this time (step S40). Subsequently, the CPU 101 calculates a difference value (an adjustment difference value) $\Delta Vt_2'$ between the low speed output value $Vt_{02}$ and the standard output value $Vt_{00}$ (step S41). The CPU 101 then updates the difference value $\Delta Vt_2$ stored in the ΔVt register of the RAM 103 with the adjustment difference value $\Delta Vt_2'$ (step S42).

It is ideal not to perform the toner supplying process during the difference-value adjustment process. This is because, to accurately calculate the adjustment difference values $\Delta Vt_1'$ and $\Delta Vt_2'$, it is important to obtain, for each of the linear velocities, the output values $Vt_{00}$, $Vt_{01}$, and $Vt_{02}$ of the magnetic permeability sensor 26 with respect to a developer having the same toner concentration. Consequently, according to the embodiment, the toner supplying process is not performed during the difference-value adjustment process. Instead, the toner supplying process is performed during an image forming process after the difference-value adjustment process is completed. In addition, it is desirable that the toner concentration during the difference-value adjustment process be around the target toner concentration. Thus, it is preferable to avoid performing the difference-value adjustment process immediately after an image with a high image size ratio is output.

Further, according to the embodiment, the difference-value adjustment control process is started when the image forming mode is changed form the standard mode to another mode, whereas the adjustment process for the difference value $\Delta Vt_1$ is performed during a warm-up period or a process control period after an image forming operation is completed; however, the adjustment process for difference value $\Delta Vt_1$ can be performed during an image forming process when the difference-value adjustment control process is started. An example of such an operation is shown in FIG. 9.

Figure 9:
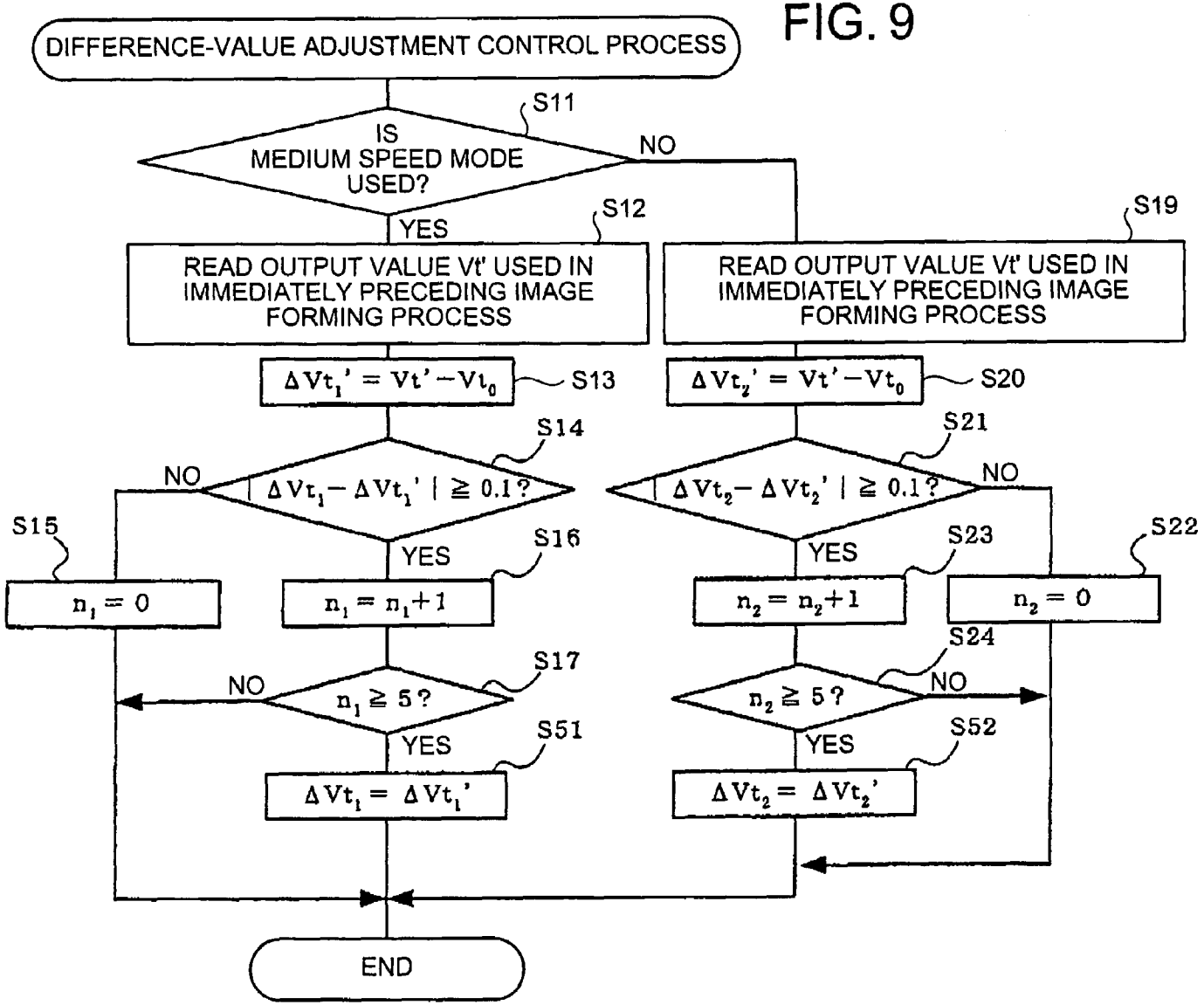
FIG. 9 is a detailed flowchart of another example of the difference-value adjustment control process.

FIG. 9 is a detailed flowchart of another example of the difference-value adjustment control process. In this example, instead of turning on the execution flag for adjusting the difference values $\Delta Vt_1$ and $\Delta Vt_2$ in the difference-value adjustment control process explained above (steps S18 and S25), the difference values $\Delta Vt_1$ and $\Delta Vt_2$ stored in the $\Delta Vt$ register of the RAM 103 are updated with the latest difference values $\Delta Vt_1'$ and $\Delta Vt_2'$ calculated at step S13 and S20 explained above (steps S51 and S52). In this case, during a warm-up period or a process control period afterwards, it is not necessary to perform the difference-value correction process, as shown in FIG. 8.

Conventionally, the difference values $\Delta Vt_1$ and $\Delta Vt_2$ used for the toner concentration control process in the medium speed mode and the low speed mode are usually fixed values. In the embodiment, however, the difference values $\Delta Vt_1$ and $\Delta Vt_2$ are adjusted according to the actual measured values at the predetermined timing. Thus, it is possible to largely improve the toner supply control performance.

However, when tens to hundreds of images are formed in series in the low speed mode, the toner concentration in a developer sometimes substantially deviates from the target toner concentration, even if the toner concentration control process is performed using the corrected output value Vt obtained by correcting the output value $Vt_0$ of the magnetic permeability sensor 26 with the adjusted deference value $\Delta Vt_1$. This is because, when images each having a high image size ratio are formed in series in the low speed mode, a large amount of toner is supplied to a developer with a low stirring/carrying speed, during the series printing process. Consequently, it is not possible to electrically charge the toner sufficiently because the developer to which the toner has been supplied cannot be stirred sufficiently. In this situation, the repulsion between toner particles is smaller than the one in the case of the ordinary amount of toner electric charge, and thus the bulk density of the developer increases. As a result, while series printing is continued, the toner concentration indicated by the output value $Vt_0$ of the magnetic permeability sensor 26 deviates toward lower values than the actual toner concentration. If the toner concentration control process is performed using the corrected output value Vt obtained by correcting the output value $Vt_0$ of the magnetic permeability sensor 26 with the difference value $\Delta Vt_1$ that has been used from before the series printing is started, the actual toner concentration becomes higher than the target toner concentration. In addition, while the series printing is performed in the low speed mode, it is not possible to obtain the output value $Vt_{00}$ corresponding to the standard linear velocity. Thus, it is not possible to adjust the difference value $\Delta Vt_1$. Consequently, when images each having a high image size ratio are formed in series in the low speed mode, the toner concentration in a developer becomes higher than the target toner concentration. As a result, the images may be smudged in the background or resolution may be lowered in detailed parts of the images.

Figure 10:
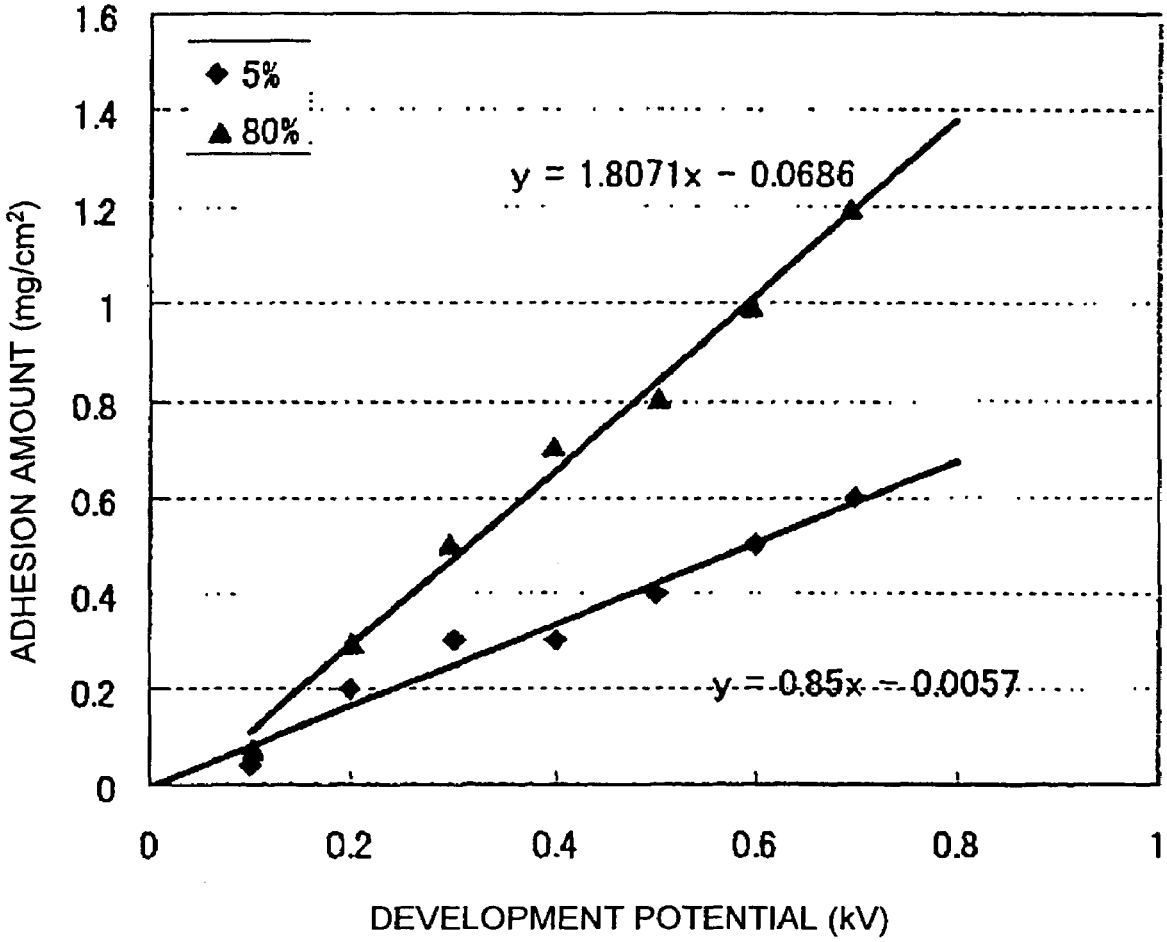
FIG. 10 is a graph for explaining changes in development γ depending on the image size ratio of images that have been previously formed.

FIG. 10 is a graph for explaining the change in development $\gamma$ (the gradient in the relational expression for the toner adhesion amount with respect to the development potential), depending on the image size ratios of images that have previously been formed. The graph indicates the result of an experiment in which 100 prints each of an image having an image size ratio of 5% and an image having an image size ratio of 80% were produced in series in the low speed mode (77 mm/s). As observed in the graph, even if the toner concentration is the same, the higher the image size ratio is, the larger the value of the development $\gamma$ is. This result implies that the physical adhesion force and the static adhesion force of toner and magnetic carriers change. Thus, it is necessary to correct the corrected output value Vt, while the difference in development capability caused by the difference in the image size ratios is taken into account. To be more specific, it is necessary to revise the corrected output value Vt, so that the value of the development $\gamma$ is constant, i.e., so that the electric charge of the toner is constant.

Therefore, according to the embodiment, a Vt revision process (step S50 in FIG. 6) is performed in which the corrected output value Vt used in the toner concentration control process in each image forming mode is revised according to the average value of the image size ratios (average image size ratio) of images that have previously been formed. The toner concentration control process is performed using the revised output value Vt.

Figure 11:
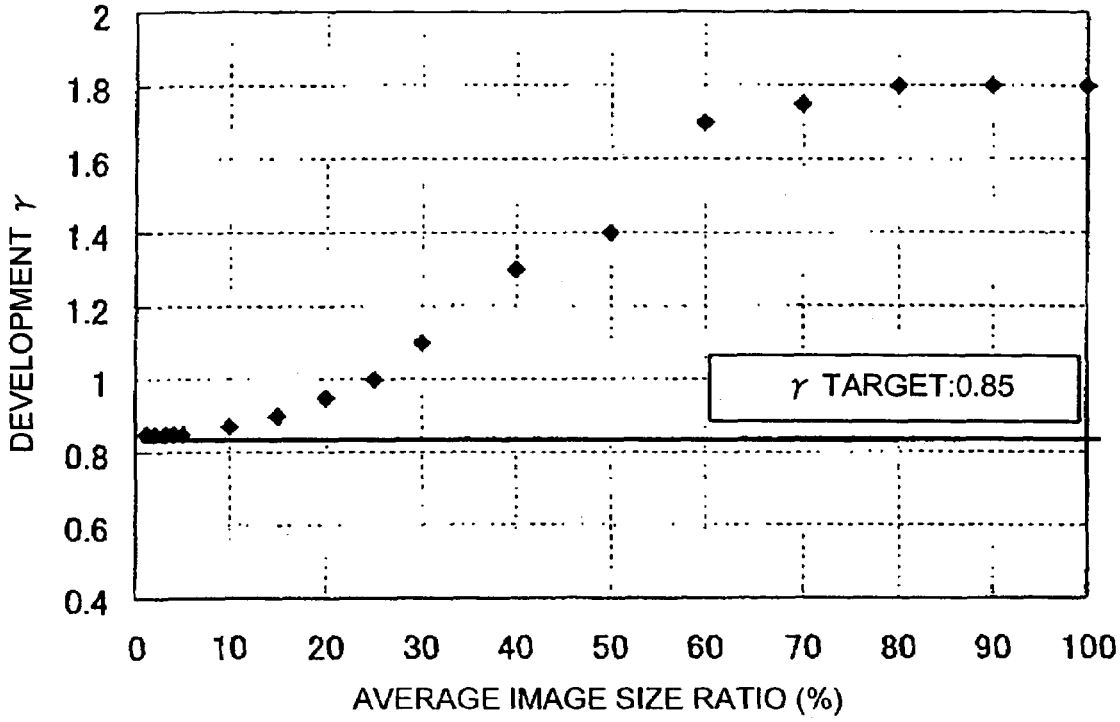
FIG. 11 is a graph of the relationship between the image size ratio and the development γ.

FIG. 11 is a graph of the relationship between the image size ratio and the development $\gamma$, in which the horizontal axis indicates the image size ratio (%), and the vertical axis indicates the development $\gamma$ ($mg/cm^2/kV$). The graph indicates the result of an experiment in which 100 prints each of images having mutually different image size ratios were produced in series in the low speed mode (77 mm/s), while the toner concentration was maintained constant. As observed in the graph, there is a tendency that the value of the development $\gamma$ increases around the point at which the image size ratio exceeds 5%. From this, it is understood that, when the image size ratio is higher than 5%, the output value Vt should be revised so that the toner concentration decreases. To be more specific, when the image size ratio is higher than 5%, the output value Vt should be revised so that the output value Vt is equal to or smaller than the target output value $Vt_{ref}$.

As explained above, according to the embodiment, the output value Vt used for the toner concentration control process in the medium speed mode is obtained by further subtracting the revision value $Vn_1$ from the corrected output value Vt obtained at step S7, i.e., by Expression (1) as follows:

$$Vt = Vt_0 - \Delta Vt_1 - Vn_1 \quad (1)$$

where $Vn_1$ is a revision value that corresponds to the average image size ratio of images that have been formed prior to the current image forming process in the series printing of the medium speed mode.

Also, the output value Vt used for the toner concentration control process in the low speed mode is obtained by further subtracting the revision value $Vn_2$ from the corrected output value Vt obtained at step S8, i.e., by Expression (2) as follows:

$$Vt=Vt_0-\Delta Vt_2-Vn_2 \quad (2)$$

where $Vn_2$ is a revision value that corresponds to the average image size ratio of images that have been formed prior to the current image forming process in the series printing of the low speed mode.

These revision values $Vn_1$ and $Vn_2$ are affected by the amount of a developer stored in the developing device 20, the stress which the developing device 20 receives (electrification start-up characteristic of the developer), the characteristics of the external additive to be released from or embedded in the surface of the toner in the developer, and the hardness of the toner surface in the developer. It is possible to calculate these revision values $Vn_1$ and $Vn_2$ from results of an experiment or the like. The specific revision values $Vn_1$ and $Vn_2$ are indicated in Table 1 below.

TABLE 1

| Average image size ratio (%) | Vn1 | Vn2 |
|---|---|---|
| 5 | 0.00 | 0.00 |
| 6 | 0.04 | 0.06 |
| 7 | 0.05 | 0.07 |
| 8 | 0.06 | 0.08 |
| 9 | 0.07 | 0.09 |
| 10 | 0.07 | 0.10 |
| 20 | 0.12 | 0.17 |
| 30 | 0.15 | 0.21 |
| 40 | 0.16 | 0.24 |
| 50 | 0.18 | 0.26 |
| 60 | 0.19 | 0.28 |
| 70 | 0.20 | 0.29 |
| 80 | 0.21 | 0.31 |
| 90 | 0.22 | 0.32 |
| 100 | 0.23 | 0.33 |

When the CPU 101 of the controlling unit 100 performs the Vt revision process (step S50), a lookup table such as Table 1 shown above is stored in the ROM 102 or the RAM 103, and the CPU 101 revises the corrected output value Vt by referring to the table.

Figure 12:
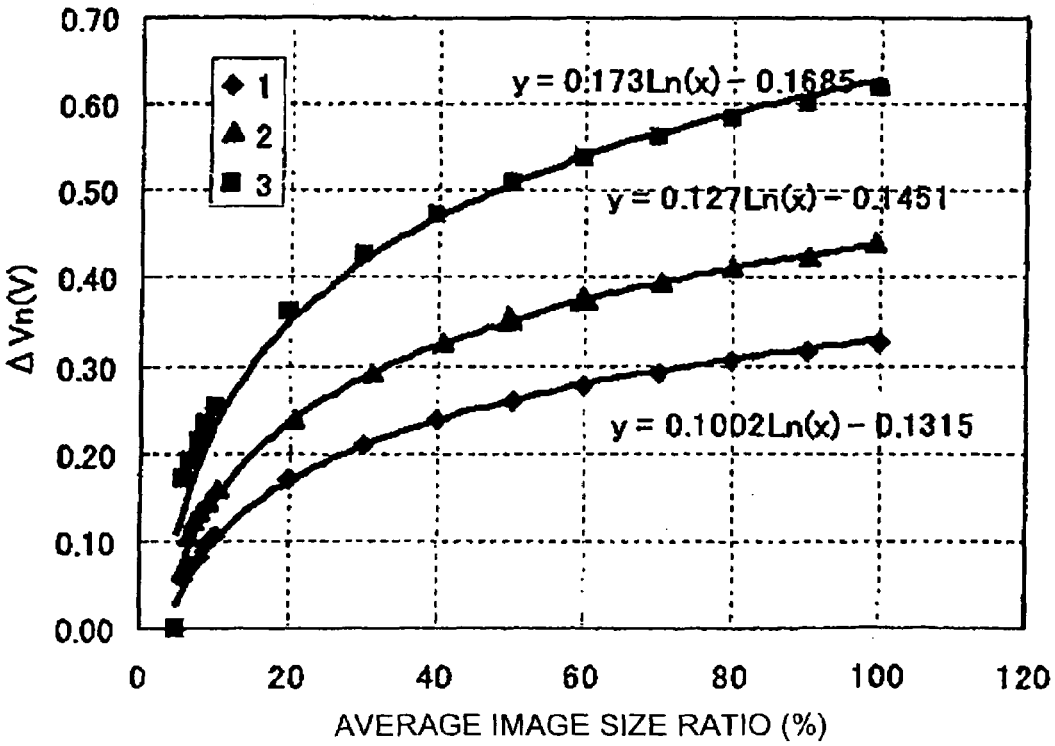
FIG. 12 is a graph for explaining revision values for the average image size ratio when the maximum values of the revision values are 0.33 volt, 0.43 volt, and 0.62 volt.

In addition, according to the embodiment, the maximum value of each of the revision values $Vn_1$ and $Vn_2$ is variable based on the log approximation, as shown in FIG. 12, depending on the characteristics of the developer and the developing device. In the graph of FIG. 12, the revision values $Vn_1$ and $Vn_2$ with respect to the average image size ratio when the maximum value of each of the revision values $Vn_1$ and $Vn_2$ is 0.33 volt, 0.43 volt, and 0.62 volt.

The revision values $Vn_1$ and $Vn_2$ are not limited to these examples, and other various appropriate values can be used. For example, when a plurality of image forming modes having mutually different process linear velocities are used as in the embodiment, the revision value for the image forming mode corresponding to the medium process linear velocity can be calculated by linear interpolation on the revision values for the image forming modes corresponding to the highest process linear velocity and the lowest process linear velocity. The revision value $Vn_1$ according to the embodiment is calculated based on linear interpolation by Expression (3) as follows:

$$Vn_1=Vn_2\times(S_0-S_1)/(S_0-S_2) \quad (3)$$

where $S_0$, $S_1$, and $S_2$ denote the process linear velocity (mm/s) in the standard mode, the medium speed mode, and the low speed mode, respectively.

Further, according to the embodiment, the average image size ratio M(i), which is used to select revision values from the lookup table shown as Table 1 above, is calculated by Expression (4) as follows:

$$M(i)=(1/N)\times\{M(i-1)\times(N-1)+X(i)\} \quad (4)$$

where N is the number of samples of the image size ratio, M(i−1) is the average image size ratio used in the immediately preceding image forming process, and X(i) is the image size ratio used in the current image forming process.

According to the embodiment, the average image size ratio M(i) used in the current image forming process is calculated using the average image size ratio M(i−1) used in the immediately preceding image forming process. Thus, it is possible to substantially reduce the area that is used in the RAM 103.

In addition, the number of samples N of the image size ratio can be changed. Thus, it is possible to change the response in the control process. For example, it is possible to exercise control effectively by changing the sample number N according to changes in environment or the elapse of time, for example.

Additionally, the toner concentration control process is performed for each of the developing devices 20 for four colors. However, the use status of a developer is different for each color. Thus, a different condition can be set for each of the developing devices 20. For example, it is desirable that, when only a monochrome image is output, the number of times the toner concentration control process is executed for the developing device for black can be increased, for example.

Next, an example of a comparison experiment in which the outcome of performing the Vt revision process (step S50) is compared with the outcome of not performing the Vt revision process will be explained.

Figure 13:
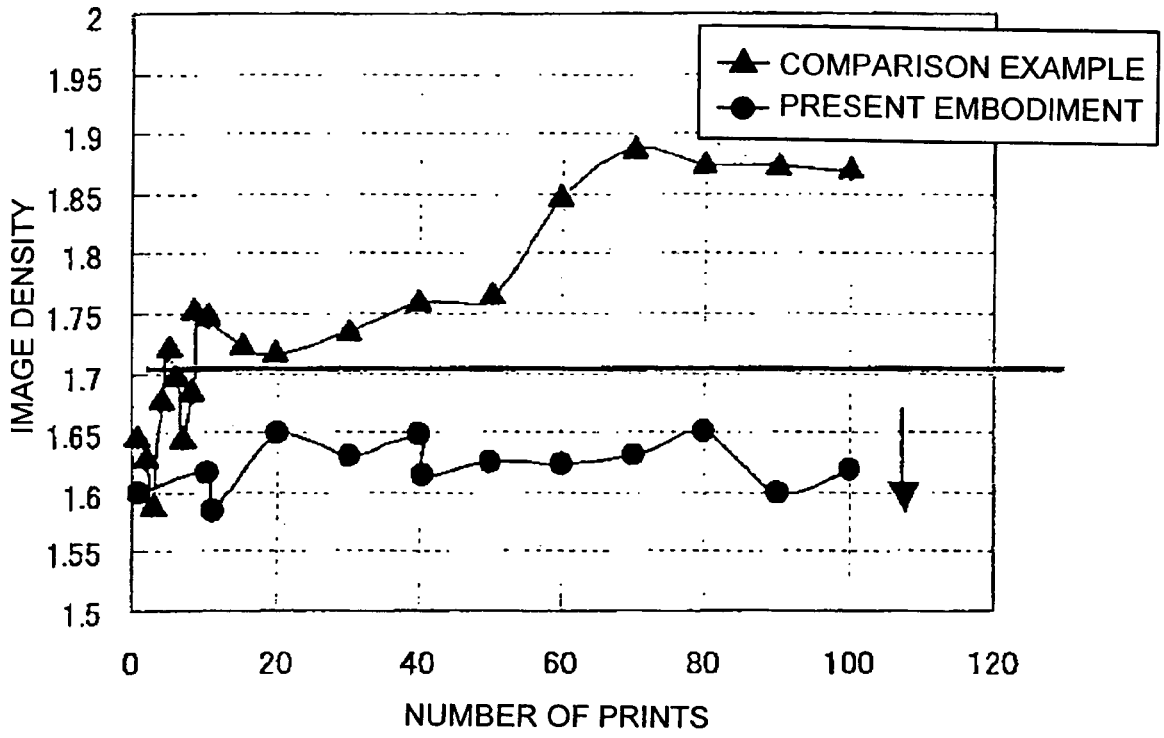
FIG. 13 is a graph for explaining the result of a comparison experiment example.

FIG. 13 is a graph for explaining the result of the comparison experiment example. In this comparison experiment example, the laser printer according to the embodiment explained above was used, and the image density was measured while 100 prints of solid images with an image size ratio of 80% were produced in series in the low speed mode (77 mm/s). In the comparison example plotted with the triangles, the image density increased as the number of prints produced in series increased because the Vt revision process (step S50) was not performed. On the other hand, in the example plotted with the dots according to the embodiment, the image density was within a range of substantially constant levels even if the number of prints produced in series increased because the Vt revision process (step S50) was performed. As a result, it was confirmed that, even if images each having a high image size ratio were printed in series in the low speed mode, it was possible to prevent the toner concentration from rising and to reliably form images with a certain level of quality by performing the Vt revision process.

As described above, according to an embodiment of the present invention, a laser printer includes a photosensitive member, a developing device, a developing sleeve, a magnetic permeability sensor, and a controlling unit. The developing device uses to develop an image a two-component developer containing toner and magnetic carriers, which is held on the developing sleeve and contacts the surface of the photosensitive member such that the toner adheres to a latent image thereon. The magnetic permeability sensor detects and outputs the amount of the toner or the number of magnetic carriers in the two-component developer present in a predetermined detection area in the developing device. The controlling unit performs toner concentration control based on the output value $Vt_0$ of the magnetic permeability sensor. The developing device includes stirring/carrying screws that stir and transport at least the two-component developer present in the detection area. The laser printer has three image forming modes (standard mode, medium speed mode, and low speed mode) in each of which image forming is performed while the two-component developer is stirred and transported by the stirring/carrying screws at a different stirring/carrying speed. The controlling unit calculates, in advance, difference values $\Delta Vt_1$ and $\Delta Vt_2$ between a reference output value $Vt_{00}$ of the magnetic permeability sensor when the two-component developer is stirred and transported by the stirring/carrying screws at the reference stirring/carrying speed, which is the stirring/carrying speed in the standard mode, and output values $Vt_{01}$ and $Vt_{02}$ of the magnetic permeability sensor when the two-component developer is stirred and transported by the stirring/carrying screws at the stirring/carrying speed in the medium speed mode or the low speed mode. When image forming is performed in the standard mode, the controlling unit performs the toner concentration control using the output value $Vt_0$ without modifying it. When image forming is performed in the medium speed mode or the low speed mode, the controlling unit performs the toner concentration control using a corrected output value Vt obtained by correcting the output value $Vt_0$ with corresponding one of the difference values $\Delta Vt_1$ and $\Delta Vt_2$. Further, the toner concentration control is performed using an image size ratio M(i) of images that have previously been formed. Thus, it is possible to inhibit changes in the output value of the magnetic permeability sensor caused by the difference in the developer stirring/carrying speed and also caused by the difference in the image size ratios of images that have previously been formed.

When images are formed in series in the medium speed mode or the low speed mode, to form the second copy of an image and copies thereafter during a series of image forming processes (during series printing), the controlling unit performs the toner concentration control using the average image size ratio M(i) of images that have previously been formed during the series printing and the corrected output value Vt. When the average image size ratio of images formed in the series printing is extremely high or extremely low, characteristic of the developer such as the amount of toner electric charge or the fluidity of the developer changes, and thereby the output value of the magnetic permeability sensor deviates. During the series printing, the difference values $\Delta Vt_1$ and $\Delta Vt_2$ cannot be corrected correspondingly to the deviation, and the toner concentration deviates from the target toner concentration. With the average image size ratio M(i) of images that have previously been formed during the series printing, however, it is possible to learn changes in the characteristic of the developer during the series printing. Consequently, the toner concentration can be prevented from deviating from the target toner concentration even if the difference values $\Delta Vt_1$ and $\Delta Vt_2$ cannot be adjusted.

The laser printer further includes a powder pump that supplies toner to the two-component developer in the developing device. When the corrected output value Vt is larger than the target output value $Vt_{ref}$, the controlling unit controls the powder pump to supply toner. In the medium speed mode and the low speed mode using the corrected output value Vt, image forming is performed while the developer is stirred and transported at a stirring/carrying speed lower than the reference stirring/carrying speed in the standard mode. The controlling unit revises the corrected output value Vt using the revision values $Vn_1$ and $Vn_2$ that allow the corrected output value Vt to be equal to or larger than the target output value $Vt_{ref}$, and performs the toner concentration control using the value obtained by the revision. When image forming is performed in series at a low stirring/carrying speed, the toner concentration tends to deviate from the target toner concentration; however, with this arrangement, such a deviation can be prevented.

The average image size ratio M(i) is calculated by Expression (4) as follows:

$$M(i)=(1/N)\times\{M(i-1)\times(N-1)+X(i)\} \quad (4)$$

where N is the number of samples of the image size ratio, M(i−1) is the average image size ratio used in the immediately preceding image forming process, and X(i) is an image size ratio used in the current image forming process.

By calculating the average image size ratio M(i) using this expression, it is possible to substantially reduce the area that is used in the RAM 103.

The controlling unit is capable of changing the sample number N of the image size ratio used to calculate the average image size ratio M(i). Thus, the response in the control process and the weighting factor can be changed. It is possible to exercise control effectively by, for example, changing the sample number N according to changes in environment or the elapse of time.

The controlling unit includes a RAM and a ROM that stores therein the revision values $Vn_1$ and $Vn_2$ corresponding to a plurality of average image size ratios M(i). The controlling unit reads the revision values $Vn_1$ and $Vn_2$ that correspond to an average image size ratio M(i) from the RAM or the ROM. The controlling unit then revises the corrected output value Vt using the revision values $Vn_1$ and $Vn_2$, and performs the toner concentration control by using the value obtained by the revision. Thus, it is possible to apply a fine-tuning revision on the corrected output value Vt. Therefore, it is possible to improve accuracy of the control and to change control steps relatively easily.

The controlling unit functions as a maximum revision amount changing unit that changes the maximum revision amount for the corrected output value Vt. The controlling unit revises the reference output value or the corrected output value, for which the maximum revision amount has been changed, using the image size ratios of images that have previously been formed, and performs the toner concentration control based on the reference output value or the corrected output value. Accordingly, the weighting of the control can be changed easily. It is also possible to exercise control effectively by, for example, changing the sample number N according to changes in environment or the elapse of time.

The laser printer includes a plurality of the developing devices each corresponding to a different color. Each of the developing devices includes the powder pump that supplies toner to the two-component developer in the developing device, and the magnetic permeability sensor. The laser printer performs image forming by superimposing, on top of one another, toner images in different colors that are developed by the developing devices, and transferring the superimposed toner images onto a transfer paper as a recording member. For each of the developing devices, the controlling unit controls the toner supply operation performed by the corresponding powder pump according to the output value $Vt_0$ of the corresponding magnetic permeability sensor. This enables an appropriate revision according to the status of use of the developer.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a developing device that applies a two-component developer containing toner and magnetic carrier to a latent image so that the toner adheres to the latent image, and develops an image, a detection area being predetermined in the developing device;

a stirring and carrying member that is located in the developing device, and stirs and carries the two-component developer in the detection area at different stirring and carrying speeds that correspond to a plurality of image forming modes including a first image forming mode and a second image forming mode, the stirring and carrying speeds including a reference stirring and carrying speed that corresponds to the first image forming mode, and a second stirring and carrying speed that corresponds to the second image forming mode;

a detecting unit that detects magnetic carrier contained in the two-component developer in the detection area, and outputs, based on detected magnetic carrier, a reference output value when the two-component developer is stirred and carried at the reference stirring and carrying speed, and a second output value when the two-component developer is stirred and carried at the second stirring and carrying speed; and a controlling unit that performs an image forming process while switching the image forming modes, and controls toner concentration, for performing the image forming process in the first image forming mode, based on the reference output value, and controls the toner concentration, for performing the image forming process in the second image forming mode, based on a corrected output value obtained by correcting an output value of the detecting unit in the second image forming mode with a difference value between the reference output value and the second output value.

2. The image forming apparatus according to claim 1, wherein, when performing the image forming process in the second image forming mode, the controlling unit calculates the difference value.

3. The image forming apparatus according to claim 1, wherein the controlling unit controls the toner concentration according to an image size ratio of an image that has previously been formed.

4. The image forming apparatus according to claim 3, wherein, upon sequential forming of images in the second image forming mode, from a predetermined image onward in the images, the controlling unit controls the toner concentration based on an average image size ratio of previous images that have previously been formed during the sequential image forming of the images and the corrected output value.

5. The image forming apparatus according to claim 4, wherein:

the developing device includes a toner supplying unit that supplies toner, and the controlling unit controls the toner supplying unit to supply toner when the corrected output value is larger than a predetermined target output value.

6. The image forming apparatus according to claim 5, wherein in the second image forming mode, the image forming process is performed while the two-component developer is stirred and carried at a stirring and carrying speed that is lower than the reference stirring and carrying speed; and the controlling unit revises the corrected output value to obtain a revised output value that is larger than the target output value, based on a revision value that corresponds to the average image size ratio of images that have previously been formed, and controls the toner concentration based on the revised output value.

7. The image forming apparatus according to claim 4, wherein the controlling unit calculates the average image size ratio M(i)by an expression as follows:

$$M(i)=(1/N)\times\{M(i-1)\times(N-1)+X(i)\},$$

where N is a number of samplings of image size ratios, M(i−1) is an average image size ratio in an immediately preceding image forming process, and X(i) is an image size ratio in a current image forming process.

8. The image forming apparatus according to claim 4, further comprising a sampling number changing unit that changes number of samplings of image size ratios that are used to calculate the average image size ratio.

9. The image forming apparatus according to claim 4, further comprising a storing unit that stores therein revision values that correspond to a plurality of average image size ratios, respectively, wherein the controlling unit reads one of the revision values from the storing unit, revises the corrected output value using read revision value to obtain a revised output value, and controls the toner concentration based on the revised output value.

10. The image forming apparatus according to claim 3, further comprising a maximum revision amount changing unit that changes a maximum revision amount for the corrected output value, wherein the controlling unit revises one of the reference output value and the corrected output value, for which the maximum revision amount has been changed, using the image size ratio of an image that has previously been formed, and controls the toner concentration based on one of revised reference output value and revised corrected output value.

11. The image forming apparatus according to claim 3, comprising a plurality of developing devices corresponding to a plurality of colors, and develop toner images in the colors, wherein each of the developing devices includes a toner supplying unit that supplies the toner, and a detecting unit, the controlling unit performs the image forming process by transferring a superimposed toner image, which is obtained by superimposing the toner images on top of one another, onto a recording member, and controls the toner supplying unit of each developing device to supply toner to the developing device based on an output value of the detecting unit of the developing device.

12. A toner concentration controlling method comprising:

a developing device applying a two-component developer that contains a toner and a magnetic carrier to a latent image so that the toner adheres to a latent image, and developing an image;

a stirring and carrying member stirring and carrying the two-component developer in a predetermined detection area at different stirring and carrying speeds that correspond to a plurality of image forming modes including a first image forming mode and a second image forming mode, the stirring and carrying speeds including a reference stirring and carrying speed that corresponds to the first image forming mode, and a second stirring and carrying speed that corresponds to the second image forming mode;

a detecting unit detecting the magnetic carrier contained in the two-component developer in the predetermined detection area, and outputting, based on the detected magnetic carrier, a reference output value when the two-component developer is stirred and carried at the reference stirring and carrying speed, and a second output value when the two-component developer is stirred and carried at the second stirring and carrying speed;

performing an image forming process while switching the image forming modes;

controlling toner concentration, for performing the image forming process in the first image forming mode, based on the reference output value; and controlling the toner concentration, for performing the image forming process in the second image forming mode, based on a corrected output value obtained by correcting an output value of the detecting unit in the second image forming mode with a difference value between the reference output value and the second output value.

* * * * *

UNITED STATES PATENT AND TRADEMARK OFFICE

CERTIFICATE OF CORRECTION

PATENT NO. : 7,493,058 B2
APPLICATION NO. : 11/498059
DATED : February 17, 2009
INVENTOR(S) : Takeuchi et al.

It is certified that error appears in the above-identified patent and that said Letters Patent is hereby corrected as shown below:

On the title page, Item (30), The Foreign Application Priority Data is incorrect. Item (30) should read:

Item -- (30) Foreign Application Priority Data

Aug. 10, 2005 (JP).....2005-232659
Aug. 22, 2005 (JP).....2005-240446 --

Signed and Sealed this

Fourteenth Day of April, 2009

John Doll

JOHN DOLL
*Acting Director of the United States Patent and Trademark Office*